US010991313B2

(12) United States Patent
Kim et al.

(10) Patent No.: US 10,991,313 B2
(45) Date of Patent: Apr. 27, 2021

(54) DISPLAY DEVICE

(71) Applicant: LG Display Co., Ltd., Seoul (KR)

(72) Inventors: Sunghun Kim, Paju-si (KR); Jihyeon Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 73 days.

(21) Appl. No.: 16/198,337

(22) Filed: Nov. 21, 2018

(65) Prior Publication Data

US 2019/0197961 A1 Jun. 27, 2019

(30) Foreign Application Priority Data

Dec. 22, 2017 (KR) ..... 10-2017-0178322

(51) Int. Cl.
*G09G 3/32* (2016.01)
*G09G 5/00* (2006.01)
*G09G 3/3266* (2016.01)

(52) U.S. Cl.
CPC ... *G09G 3/3266* (2013.01); *G09G 2300/0408* (2013.01); *G09G 2300/0439* (2013.01); *G09G 2310/0281* (2013.01); *G09G 2320/0223* (2013.01); *G09G 2320/0233* (2013.01)

(58) Field of Classification Search
CPC .. G09G 3/20; G09G 3/30; G09G 3/34; G09G 3/14; G09G 3/36; G09G 3/3266; G09G 3/3233; G09G 3/2092; G09G 3/3677; G09G 3/3696; G09G 3/32; G09G 3/3225; G09G 3/3258; G09G 3/3275; G09G 5/00; G09G 5/10; G09G 5/12; G02F 1/13; G02F 1/133; G02F 1/1337; G02F 1/1339; G02F 1/1343; G02F 1/1362; G02F 1/1333; G02F 1/1368; G02F 1/1335; H01L 27/15; H01L 27/32; H01L 33/00; H01L 33/36
See application file for complete search history.

(56) References Cited

U.S. PATENT DOCUMENTS 8,259,045 B2 9/2012 Ahn et al.
2005/0168491 A1* 8/2005 Takahara ..... G09G 3/006 345/690
2007/0075955 A1* 4/2007 Jung ..... G09G 3/3225 345/92
2007/0262916 A1* 11/2007 Kee ..... G02F 1/13336 345/1.3
2009/0251394 A1 10/2009 Ahn et al.
2010/0110329 A1* 5/2010 Kubota ..... G02B 6/0068 349/60

(Continued)

FOREIGN PATENT DOCUMENTS

KR 10-2009-0105758 A 10/2009

*Primary Examiner* — Chanh D Nguyen
*Assistant Examiner* — Nguyen H Truong
(74) *Attorney, Agent, or Firm* — Fenwick & West LLP

(57) ABSTRACT

A display device includes a display panel, a left scan driver, a right scan driver, and a central scan driver. The display panel has a display area in which an image is displayed, and a non-display area in which an image is not displayed. The left scan driver and the right scan driver are respectively arranged in left and right non-display areas of the display panel. The central scan driver is arranged in a central area of the display panel. Subpixels adjacent to the central area of the display panel are small in size compared to subpixels arranged in other areas of the display panel.

12 Claims, 10 Drawing Sheets

(56) References Cited

U.S. PATENT DOCUMENTS

| | | | | |
|---|---|---|---|---|
| 2012/0194773 | A1* | 8/2012 | Kim | G02F 1/13336 349/139 |
| 2015/0116619 | A1* | 4/2015 | Yi | G02B 30/27 349/43 |
| 2015/0226998 | A1* | 8/2015 | Bang | G02F 1/133377 349/43 |
| 2018/0090052 | A1* | 3/2018 | Marsh | G09G 3/001 |
| 2019/0114961 | A1* | 4/2019 | Chang | G09G 3/3225 |

* cited by examiner (a)

(b)

(a)

(b)

① PUT > PUTC ② PDT > PDTC ③ CON > CONC

DISPLAY DEVICE

This application claims the benefit of Republic of Korea Patent Application No. 10-2017-0178322, filed on Dec. 22, 2017, which is incorporated herein by reference in its entirety.

BACKGROUND

Field of the Disclosure

The present disclosure relates to a display device.

Related Art

With the development of information technologies, the market of displays used as a medium for connecting user and information is growing in size. Accordingly, displays based on display devices such as a Liquid Crystal Display (LCD), a Field Emission Display (FED), a Light Emitting Display (LED), and an Electrophoresis (EFD), are used more widely.

A display device includes a display panel including a plurality of subpixels, and a driver for driving the display panel. The driver includes a scan driver for supplying a scan signal (or a gate signal) to the display panel, and a data driver for supplying a data signal to the display panel.

The display device is able to display an image as the subpixels emits light when a scan signal, a data signal, and the like are supplied to the subpixels. However, if a large display panel is implemented, an existing proposed display may have problems that a luminescent deviation of the display panel possibly occurs due to scan signal delay and that a display quality is possibly degraded. There is a need of a solution for these problems.

SUMMARY

The present disclosure provides a light emitting display device including a display panel, a left scan driver, a right scan driver, and a central scan driver. The display panel has a display area in which an image is displayed, and a non-display area in which an image is not displayed. The left scan driver and the right scan driver are respectively arranged in left and right non-display areas of the display panel. The central scan driver is arranged in a central area of the display panel. Subpixels adjacent to the central area of the display panel are small in size compared to subpixels arranged in other areas of the display panel.

In another general aspect, the present disclosure provides a light emitting display device including a display panel, a left scan driver, a right scan driver, and a central scan driver. The display panel has a display area in which an image is displayed, and a non-display area in which an image is not displayed. The left scan driver and the right scan driver are respectively arranged in left and right non-display areas of the display panel. The central scan driver is arranged in a central area of the display panel. The central scan driver has a small output buffer, compared to the left and right scan drivers.

BRIEF DESCRIPTION OF THE DRAWINGS

The accompany drawings, which are included to provide a further understanding of the disclosure and are incorporated on and constitute a part of this specification illustrate embodiments of the disclosure and together with the description serve to explain the principles of the disclosure.

DETAILED DESCRIPTION

Reference will now be made in detail embodiments of the disclosure examples of which are illustrated in the accompanying drawings.

In the following description, the present disclosure may be implemented as a TV, a video player, a personal computer (PC), a home theater, a smart phone, a virtual reality (VR) device, an augmented reality (AR) device, a vehicle display, etc. In addition, the present disclosure may be applied not just to an organic light emitting display device implemented based on organic light emitting diodes (a Light Emitting Display (LED)), abut also to an inorganic light emitting display device implemented based on inorganic light emitting diodes. However, the present disclosure will be hereinafter described as an organic light emitting display device.

Figure 1:
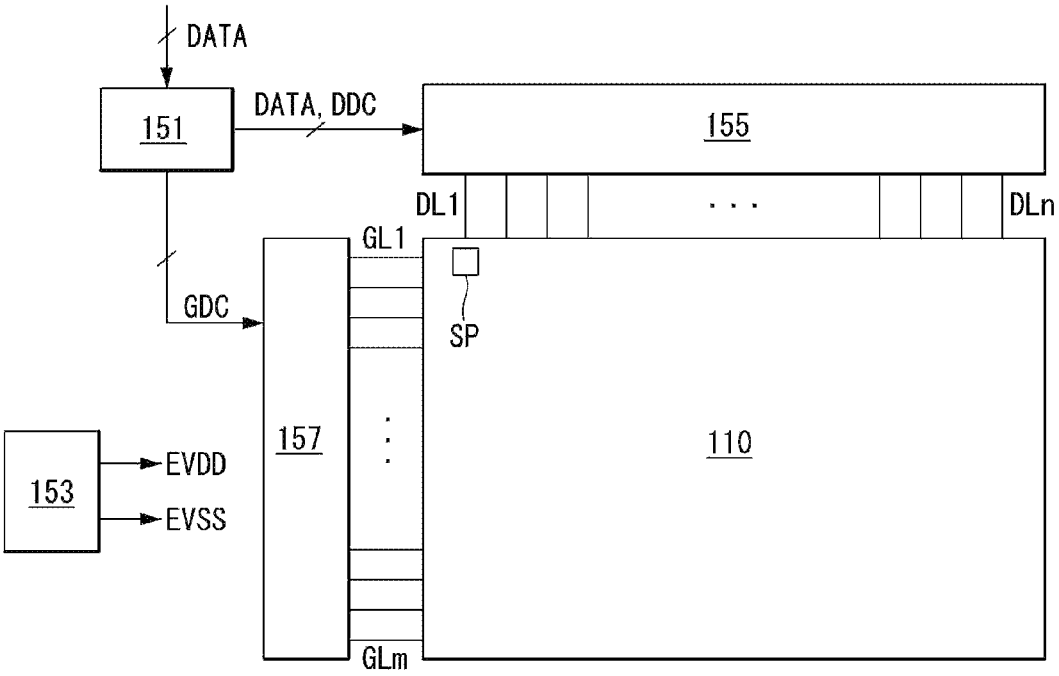
FIG. 1 is a schematic block diagram of an organic light emitting diode display according to an embodiment of the present disclosure.
Figure 2:
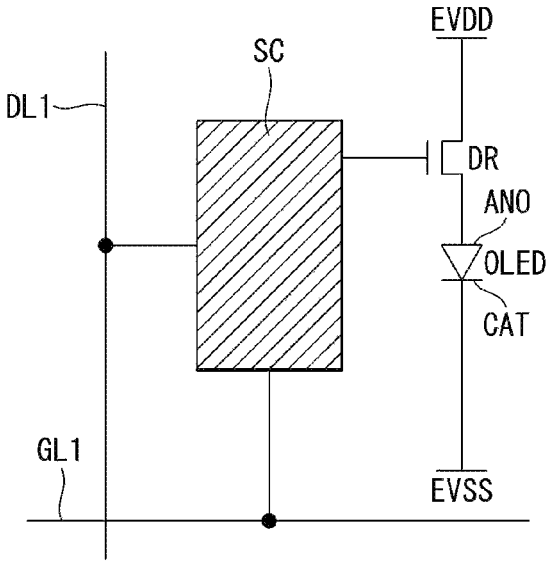
FIG. 2 is a schematic circuit diagram of a subpixel according to an embodiment of the present disclosure.
Figure 3:
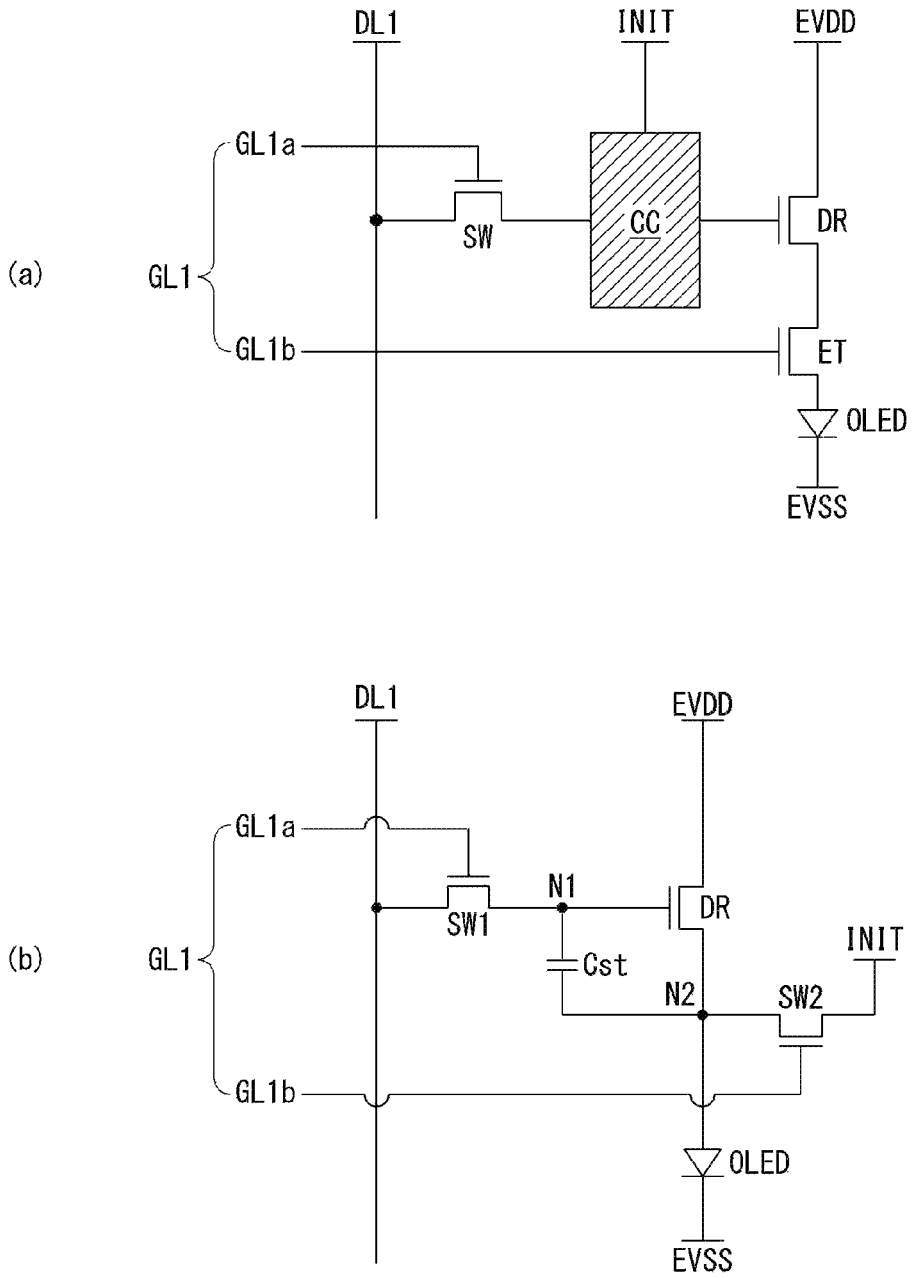
FIG. 3 is a diagram illustrating a circuit configuration specifically showing part of FIG. 2 according to an embodiment of the present disclosure.
Figure 4:
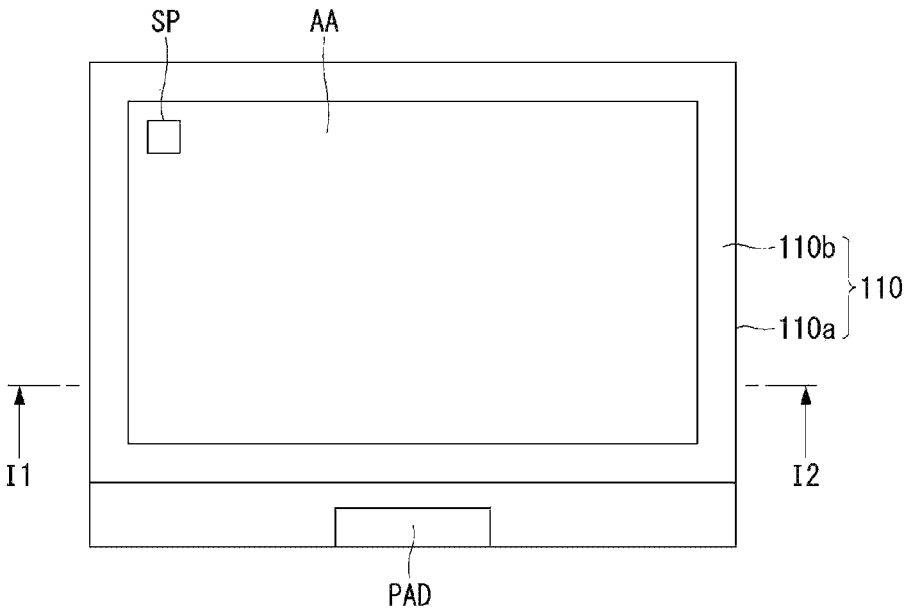
FIG. 4 is a plan view of a display panel according to an embodiment of the present disclosure.
Figure 5:
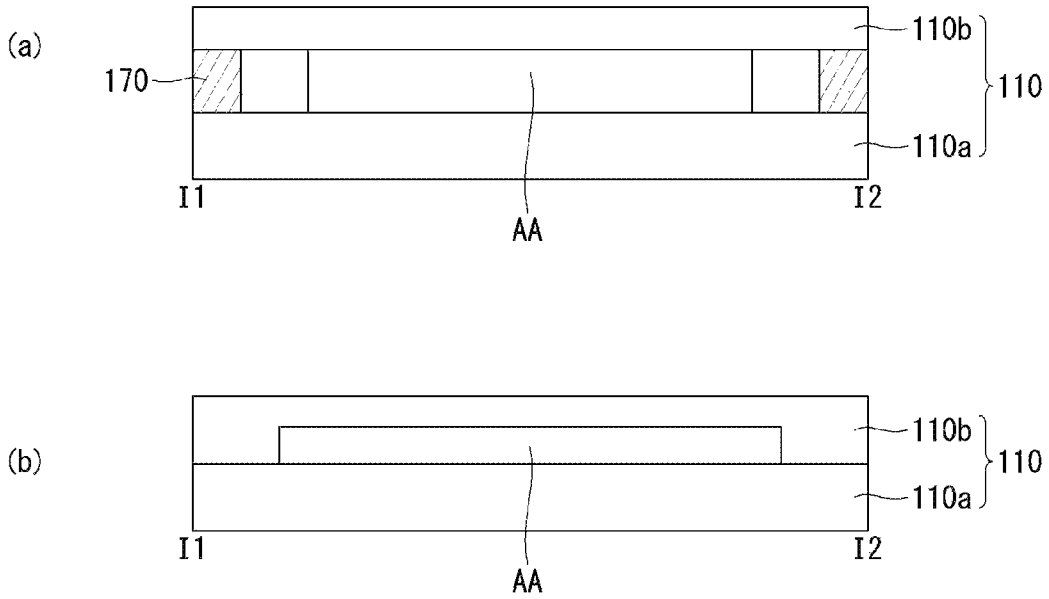
FIG. 5 is a cross-sectional view of an I1-I2 area shown in FIG. 4 according to an embodiment of the present disclosure.

FIG. 1 is a schematic block diagram of an organic light emitting diode display according to an embodiment of the present disclosure, FIG. 2 is a schematic circuit diagram of a subpixel according to an embodiment of the present disclosure, FIGS. 3A and 3B are diagrams illustrating a circuit configuration specifically showing part of FIG. 2 according to an embodiment of the present disclosure, FIG. 4 is a plan view of a display panel according to an embodiment of the present disclosure, and FIG. 5 is a cross-sectional view of an I1-I2 area shown in FIG. 4 according to an embodiment of the present disclosure.

As illustrated in FIG. 1, the organic light emitting display may include a timing controller 151, a data driver 155, a scan driver 157, a display panel 110, and a power supply 153.

The timing controller 151 receives a driving signal including an enable signal, a vertical synchronization signal, a horizontal synchronization signal, and a clock signal from an image processing unit (not shown) in addition to a data signal DATA. The timing controller 151 outputs a gate timing control signal GDC for controlling an operation timing of the scan driver 157, and a data timing control signal DDC for controlling an operation timing of the data driver 155 based on a driving signal. The timing controller 151 may be in the form of an Integrated Circuit (IC).

In response to a timing control signal DDC supplied from the timing controller 151, the data driver 155 samples and latches a data signal DATA supplied from the timing controller 151, convert the digital data signal into an analog data signal (or a data voltage) as a gamma reference voltage, and output the analog data signal (or the data voltage). The data driver 155 outputs a data signal DATA through data lines DL1 to DLn. The data driver 155 may be in the form of an IC.

The scan driver 157 outputs a scan signal in response to a gate timing control signal GDC supplied from the timing controller 151. The scan driver 157 outputs the scan signal through scan lines GL1 to GLm. The scan driver 157 is formed in an IC form or formed in the display panel 110 in a Gate In Panel (GIP) method (a method of forming a transistor in a thin film process).

The power supply 153 outputs a high-potential voltage and a low-potential voltage. The high-potential voltage and the low-potential voltage output from the power supply 153 are supplied to the display panel 110. The high-potential voltage is supplied to the display panel 110 through a first power line EVDD, and the low-potential voltage is supplied to the display panel 110 through a second power line EVSS. The power supply 153 may be formed in an IC form.

The display panel 110 displays an image based on a data signal DATA from the data driver 155, a scan signal from the scan driver 157, and power from the power supply 153. The display panel 110 includes subpixels SP operate to emit light so that an image is displayed.

The subpixels SP may include a red subpixel, a green subpixel, and a blue subpixel, or may include a white subpixel, a red subpixel, a green subpixel, and a blue subpixel. The subpixels SP may have one or more emission areas depending on emission characteristics.

As illustrated in FIG. 2, one subpixel is disposed at an intersection between a data line DL1 and a scan line GL1, and includes an organic light emitting diode (OLED) and a programming unit SC for setting a gate-source voltage of a driving transistor DR.

The OLED includes an anode ANO, a cathode CAT, and an organic emission layer interposed between the anode ANO and the cathode CAT. The anode ANO is connected to the driving transistor DR.

The programming unit SC may be implemented as a transistor unit (a transistor array) including at least one switching transistor and at least one capacitor. The transistor unit is implemented based on a CMOS semiconductor, a PMOS semiconductor, or an NMOS semiconductor. Transistors included in the transistor unit may be implemented as a p type or an n type. In addition, semiconductor layers of transistors included in a transistor unit of a subpixel may include amorphous silicon, polysilicon, or oxide materials.

The switching transistor is turned on in response to a scan signal from the scan line GL1 to thereby apply a data voltage from the data line DL1 to an electrode disposed at one side of the capacitor. Based on a size of a voltage charged in the capacitor, the driving transistor DR controls an amount of currents so as to adjust an amount of light emission of the OLED. The amount of light emission of the OLED is proportional to an amount of currents supplied from the driving transistor DR. In addition, a subpixel is connected to the first power line EVDD and the second power line EVSS, and supplied with a high-potential voltage and a low-potential voltage from the first power line EVDD and the second power line EVSS.

As illustrated in FIG. 3 (*a*), a subpixel may include an emission control transistor ET and a compensation circuit CC in addition to the aforementioned elements such as a switching transistor SW, a driving transistor DR, a capacitor, and an OLED.

In response to a scan signal for switching supplied through a 1A scan line GL1*a*, the switching transistor SW supplies a data voltage, supplied through the data line DL1, to a first node N1. In addition, in response to a scan signal for emission control supplied through the 1B scan line GL1*b*, the emission control transistor ET controls an emission time of the OLED. The position of the OLED is merely exemplary, and the OLED may be disposed between the first power line EVDD and the driving transistor DR.

As illustrated in FIG. 3 (*b*), a subpixel may include a switching transistor SW1, a driving transistor DR, a sensing transistor SW2, a capacitor Cst, and an OLED. The sensing transistor SW2 is a transistor capable of being included in a compensation circuit, and performs a sensing operation to compensate for the subpixel.

In response to a scan signal for switching supplied through a 1A scan line GL1*a*, the switching transistor SW1 supplies a data voltage, supplied through a data line DL1, to a first node N1. In addition, in response to a scan signal for sensing supplied through a 1B scan line GL1*b*, the sensing transistor SW2 initializes or senses a second node N2 disposed between the driving transistor DR and the OLED. The sensing transistor SW2 initializes or senses the second node N2 by connecting the driving transistor DR and the organic light emitting diode OLED to the compensation line INIT. The compensation circuit is merely an exemplary, and aspects of the present disclosure are not limited thereto.

Meanwhile, the circuit configuration of a subpixel shown in FIG. 3 is only to provide a better understanding. That is, the circuit configuration of a subpixel according to the present disclosure is not limited thereto, and may be any of various configurations, such as 2T(Transistor)1C(Capacitor), 3T1C, 4T2C, 5T2C, 6T2C, and 7T2C.

As illustrated in FIG. 4, the display panel 110 includes a first substrate 110*a*, a second substrate 110*b*, a display area AA, a pad part PAD, etc. The display area AA is composed of subpixels SP which emit light. The subpixels SP of the display area AA is air-tightly sealed due to their vulnerability to humidity and oxygen, but the pad part PAD is composed of pads for electrical connection with an external substrate and thus the pad part PAD is exposed to the outside.

The display area AA may be arranged to occupy most of the entire surface of the first substrate 110*a*, and the pad part PAD may be arranged at an outer periphery of one side of the first substrate 110*a*. The display panel 110 is depicted as being implemented in a rectangular shape, but the display panel 110 may be implemented in any other shape including a pentagonal shape, a hexagonal shape, a polygonal shape, a circular shape, an elliptical shape, etc.

As illustrated in FIGS. 4 and 5 (*a*), the display area AA may be sealed by a sealing member 170 existing between the first substrate 110*a* and the second substrate 110*b*. As illustrated in FIGS. 4 and 5 (*b*), the display area AA may be sealed only by the first substrate 110*a* and the second substrate 110*b*.

The display panel 110 may have any other various shapes including a flat shape, a flexibly bendable shape, and a shape having a curved surface. Thus, the sealed structure of the display panel 110 may be selected according to a shape desired to achieve, and thus, the sealed structure is not limited to the description about FIGS. 4 and 5.

However, in the case of an existing display, if the display panel 110 is manufactured in a large size, a luminance deviation may occur and a display quality may be degraded due to scan signal delay. These problems will be addressed as below.

Figure 6:
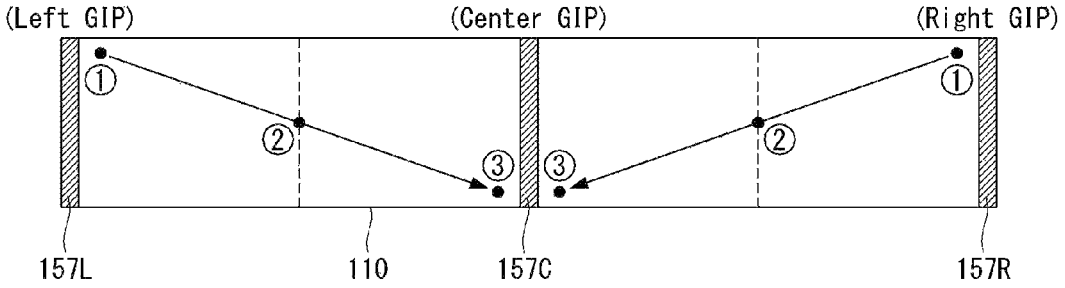
FIG. 6 is a diagram schematically illustrating a display panel according to an embodiment of the present disclosure.
Figure 7:
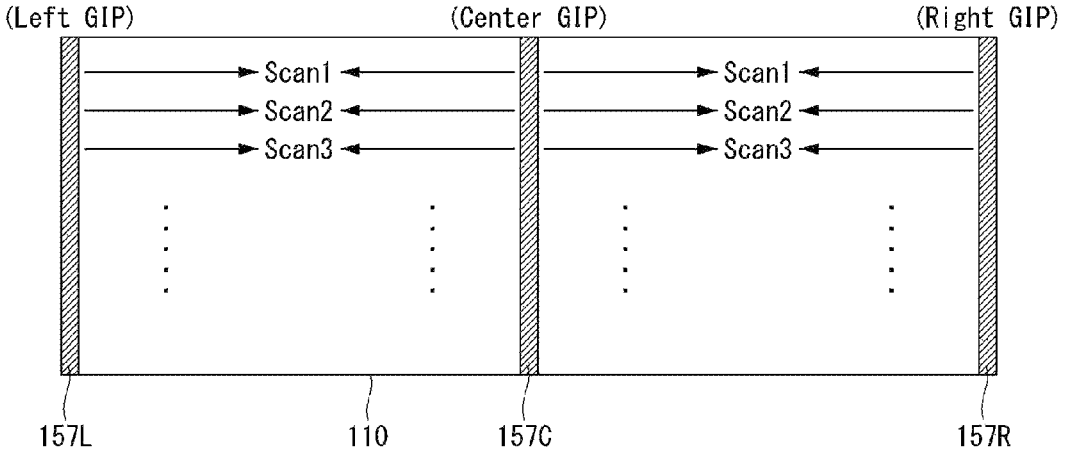
FIG. 7 is a diagram illustrating directions in which scan signals are output in the display panel shown in FIG. 6 according to an embodiment of the disclosure.
Figure 8:
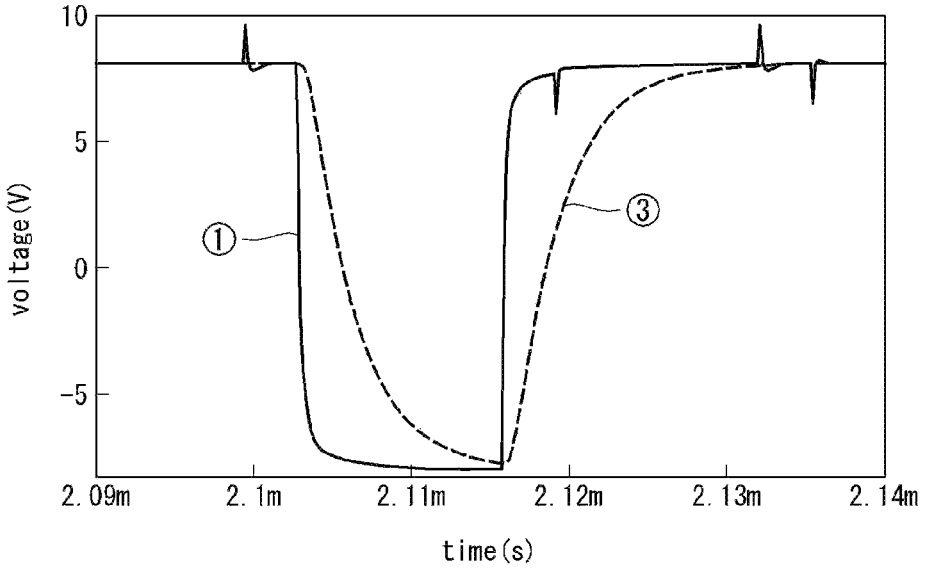
FIG. 8 is a diagram for explaining change in a scan signal depending on the presence or absence of a central scan driver according to an embodiment of the disclosure.
Figure 8:
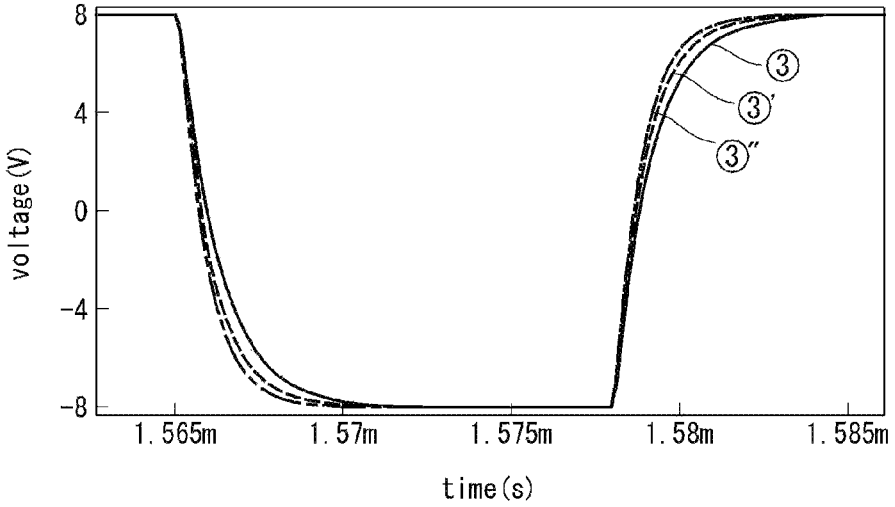

FIG. 6 is a diagram schematically illustrating a display panel according to an embodiment of the present disclosure, FIG. 7 is a diagram illustrating directions in which a scan signals are output in the display panel shown in FIG. 6 according to an embodiment of the present disclosure, and FIG. 8 is a diagram for explaining change in a scan signal depending on the presence or absence of a central scan driver according to an embodiment of the present disclosure.

As illustrated in FIG. 6, a display panel 110 according to an embodiment of the present disclosure includes scan drivers 157L, 157C, and 157R formed in a GIP method. A left scan driver 157L is arranged in the left area Left GIP of the display panel 110, a central scan driver 157C (an auxiliary scan driver) is arranged in the central area Center GIP of the display panel 110, and a right scan driver 157R is arranged in the right area Right GIP of the display panel 110.

The areas in which the left scan driver 157L and the right scan driver 157R are arranged correspond to non-display areas of the display panel 110 in which an image is not displayed, and the area in which the central scan driver 157C is arranged corresponds to a display area of the display panel 110 in which an image is displayed. The area in which the left scan driver 157L is arranged may be defined as a left non-display area, and the area in which the right scan driver 157R is arranged may be defined as a right non-display area.

As illustrated in FIG. 7, the left scan driver 157L outputs scan signals Scan1 to Scan 3 to the central scan driver 157C which is arranged at the center of the display panel 110. The central scan driver 157C outputs the scan signals, e.g. Scan 1 to Scan 3 to the left scan driver 157L and the right scan driver 157R which are arranged on the left and right sides of the display panel 110. The right scan driver 157R outputs the scan signals Scan1 to Scan3 to the central scan driver 157C which is arranged at the center of the display panel 110.

The left scan driver 157L, the central scan driver 157C, and the right scan driver 157R may output the scan signals, e.g. Scan1 to Scan 3 in a sequential direction from the top to the bottom of the display panel 110 or in a reverse sequential direction from the bottom to the top of the display panel 110. In addition, the left scan driver 157L, the central scan driver 157C, and the right scan driver 157R may output the scan signals Scan1 to Scan3 in a non-sequential method, regardless of a direction from the top to the bottom or the bottom to the top of the display panel 110.

Although arranged in different areas, the left scan driver 157L, the central scan driver 157C, and the right scan driver 157R are synchronized with each other so as to simultaneously output the identical scan signals Scan1 to Scan3. In addition, each of the scan signals Scan1 to Scan3 output from the left scan driver 157L, the central scan driver 157C, and the right scan driver 157R is composed of a single signal or a plurality of signals.

More specifically, the first scan signal Scan1 is depicted as one signal which is output in response to one scan line, e.g. GL1. However, it is merely exemplary, and the scan line may be composed of at least two scan lines, and the first scan signal Scan1 may include at least two scan signals in response to the at least two scan lines. For example, the first scan signal Scan1 may include two signals, a scan signal for switching and a scan signal for emission control. The scan signal for switching is a signal for turning on or off a switching transistor to apply a data voltage to a subpixel. The scan signal for emission control is a signal for turning on and off an emission control transistor to control an emission time of a subpixel.

As described with reference to FIGS. 2 and 3, one, two, or more scan signals from each scan line are required depending on a circuit configuration of subpixels included in a display panel. In addition, such scan signals may be used as a scan signal for switching, a scan signal for emission control, or a scan signal for other purpose (e.g. a scan signal for resetting). Thus, each of the scan signals Scan1 to Scan3 output from the left scan driver 157L, the central scan driver 157C, and the right scan driver 157R should be interpreted as including at least one signal and as being capable of being used for various purposes.

FIG. 8 (*a*) is a simulation result showing change in a scan signal between a first point ① and a third point ③ when the left scan driver 157L and the right scan driver 157R are driven while the central scan driver 157C is stopped from being driven in the structure shown in FIG. 6.

FIG. 8 (*b*) is a simulation result showing change in a scan signal at a third point ③ when the central scan driver 157C as well as the left scan driver 157L and the right scan driver 157R are driven all together in the structure shown in FIG. 6.

As illustrated in FIG. 8 (*a*), if the left scan driver 157L and the right scan driver 157R are driven with the central scan driver 157C stopped from being driven, a deviation in a pulse of a scan signal, as shown in the first point ① and the third point ③ is found. However, as illustrated in FIG. 8 (*b*), if the central scan driver 157C as well as the left scan driver 157L and the right scan driver 157R are driven all together, a deviation in the pulse of the scan signal is hardly found. For this reason, different points are not marked as the first point ① and the third point ③ in FIG. 8 (*b*).

The first point ① is close to input terminals of scan signals output from the left scan driver 157L and the right scan driver 157L. However, the third point ③ is the most distal point from the input terminals of the scan signals, unlike the first point ① or a second point ②. That is, the third point ③ corresponds to the worst point at which a scan signal is delayed most. Thus, it is found that solving the scan signal delay heavily depends on whether or not the central scan driver 157C is driven. In addition, if the central scan driver 157C is driven, the scan signal delay is solved, and thus, it is possible to solve a luminance deviation of the display panel and degradation of a display quality.

In addition, FIG. 8 (*b*) shows a simulation result regarding a third' point ③ ' and a third point" ③ " as well as the example of the third point ③. The simulation result regarding the third' point ③ ' and the third point" ③ " is a miniaturized circuit of the central scan driver 157C compared to the circuits of the left scan driver 157L and the right scan driver 157R.

More specifically, the simulation result regarding the third' point ③' and the third point" ③" is a smaller-sized output buffer of the central scan driver 157C compared to that of a simulation result regarding the third point ③.

Thus, as it is found based on these simulation results, when the central scan driver 157C is implemented in the display panel 110, miniaturizing (e.g., a minimum-sized output buffer) or simplifying (e.g., a simplified circuit configuration) the central scan driver 157C compared to the left scan driver 157L and the right scan driver 157R does not lead to a big problem performance.

Figure 9:
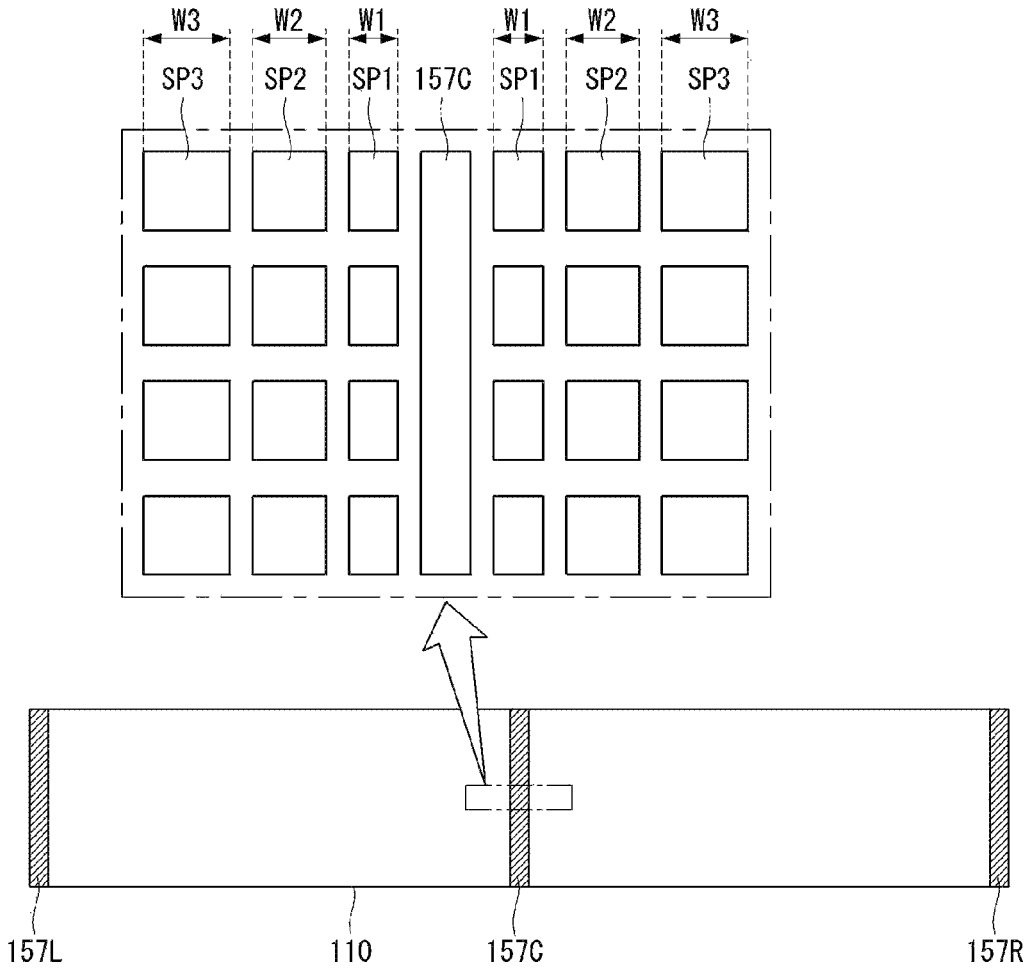
FIG. 9 is a plan view for schematically explaining an example of arrangement of subpixels near the center of a central scan driver in a central area of a display panel according to an embodiment of the present disclosure.
Figure 10:
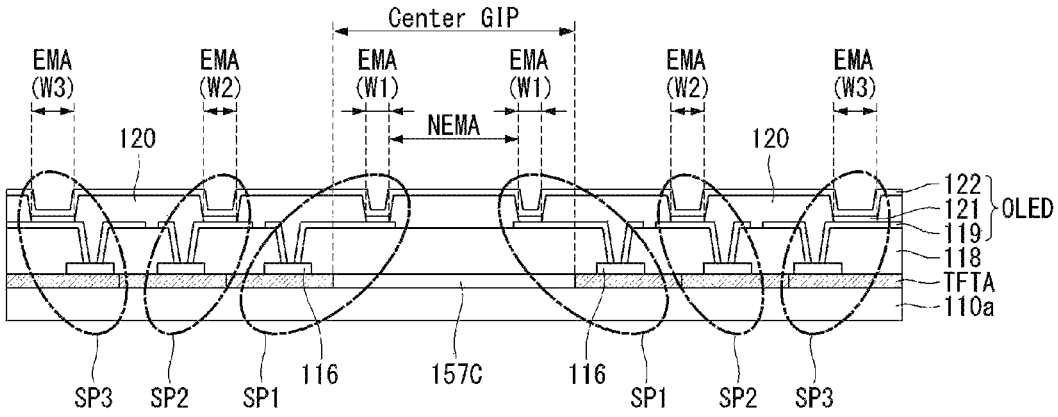
FIG. 10 is a cross-sectional view for schematically explaining an example of arrangement of subpixels to arrange a central scan driver in the central area of a display panel according to another embodiment of the present disclosure.
Figure 11:
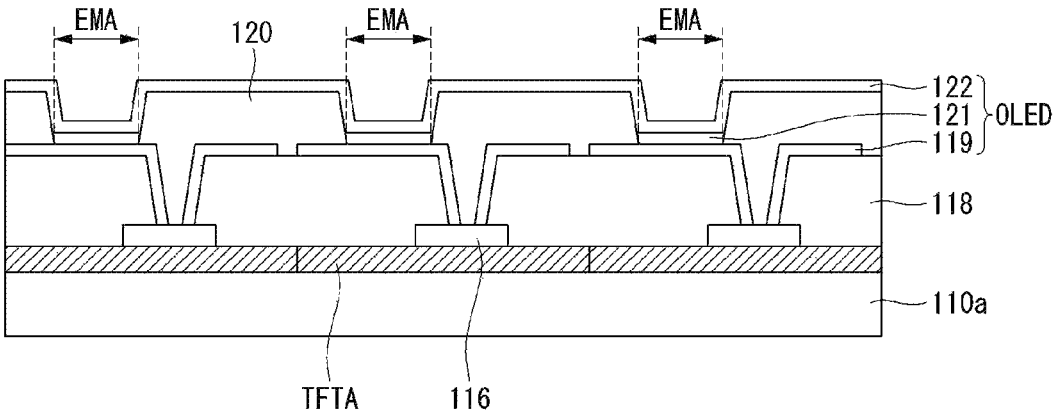
FIG. 11 is a diagram for explaining change in a display panel according to the present disclosure.
Figure 11:
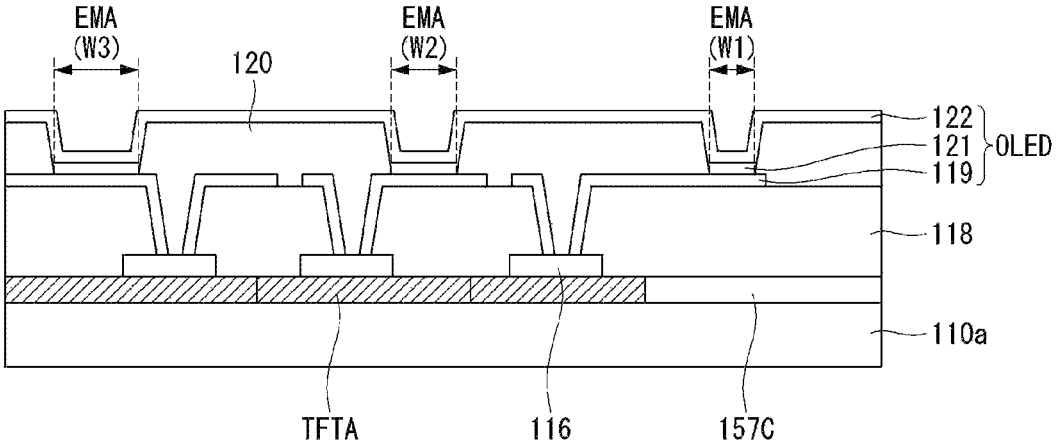

FIG. 9 is a plan view for schematically explaining an example of arrangement of subpixels near the center of a central scan driver in a central area of a display panel according to an embodiment of the present disclosure, FIG. 10 is a cross-sectional view for schematically explaining an example of arrangement of subpixels to arrange a central scan driver in the central area of a display panel according to another embodiment of the present disclosure, and FIG. 11 is a diagram for explaining change in a display panel according to the present disclosure.

As illustrated in FIG. 9, first subpixels SP1, second subpixels SP2, and third subpixels SP3 arranged adjacent to the central area of the display panel 110 have a different size compared to subpixels arranged in other areas. The first subpixels SP1, the second subpixels SP2, and the third subpixels SP3 arranged adjacent to the central area of the display panel 110 decrease in size toward the central scan driver 157C.

For example, the first subpixels SP1 may be arranged in the most adjacent left and right areas of the central scan driver 157C, the second subpixels SP2 may be arranged outside the first subpixels SP1, and the third subpixels SP3 may be arranged outside the second subpixels SP2. The first subpixels SP1, the second subpixels SP2, and the third subpixels SP3 are arranged on the left and right sides of the central scan drivers 157C and have corresponding sizes with each other, and thus like reference numerals and like names are given respectively.

The first subpixels SP1 arranged most adjacent to the central scan driver 157C may have a first width W1 for its OLED, the third subpixels SP3 arranged most distal from the central scan driver 157C may have a third width W3 for its OLED, and the second subpixels SP2 arranged between the first subpixels SP1 and the third subpixels SP3 may have a second width W2 for its OLED. The respective widths set for the first subpixels SP1, the second subpixels SP2, and the third subpixels SP3 may be the first width W1< the second width W2< and the third width W3. That is, in the case where the subpixels are designed to be small in size toward the central scan driver 157C, the subpixels may have the widths for its OLED as above.

In the above example, subpixel units decrease in width so that the subpixel units are small in size toward the central scan driver 157C. However, it is merely exemplary, and a pixel unit or a group unit may have a smaller width. In this case, one group may include at least two subpixels or at least two pixels, but aspects of the present disclosure are not limited thereto. The reason that subpixels are aligned in this manner is because the central scan driver 157C is arranged in the display area of the display panel 110 and also because it is necessary to consider the case where the subpixels emits light toward a first substrate.

In the above description, subpixels adjacent to the central area of the display panel 110 may be defined as subpixels which are included in the left and right adjacent areas of the central scan driver 157C, except the left and right outer areas, among quadrants of the display panel 110 with reference to the central scan driver 157C (for example, equally dividing the display area into four areas as shown in FIG. 6).

Meanwhile, FIG. 9 shows an example in which the central scan driver 157C and the first subpixels SP1 disposed around the central scan driver 157C are separated. However, the central scan driver 157C and the first subpixels SP1 disposed around the central scan driver 157C may be formed to partially overlap each other, and an example thereof is illustrated in FIG. 10.

As illustrated in FIG. 10, the first subpixels SP1, the second subpixels SP2, and the third subpixels SP3 are implemented based on a transistor unit TFTA and an OLED which are formed on a first substrate 110*a*.

The transistor unit TFTA is disposed above the first substrate 110*a*. The transistor unit TFTA includes a switching transistor, a driving transistor, a capacitor, a power line, etc. which are disposed to respectively correspond to the first subpixels SP1, the second subpixels SP2, and the third subpixels SP3.

As described above with reference to FIG. 3, the transistor unit TFTA may have various configurations and have various stacked structures, such as a top gate structure and a bottom gate structure, depending on a position of a gate electrode. Thus, the transistor unit TFTA is not illustrated in a detail fashion. Configurations, such as a switching transistor, a driving transistor, and a capacitor, included in the transistor unit TFTA are protected by a protective layer and the like.

An insulating layer 118 is disposed on the transistor unit TFTA. The insulating layer 118 may be selected as a planarization layer having a flat surface, but aspects of the present disclosure are not limited thereto. The insulating layer 118 has a contact hole which exposes a source or drain electrode 116 of the driving transistor. An OLED is disposed on the insulating layer 118. The OLED includes: a first electrode layer 119 connected to the source or drain electrode 116 of the driving transistor; an emission layer 121; and a second electrode layer 112. The first electrode layer 119 may be selected as an anode (or a cathode), and the second electrode 122 may be selected as the cathode (or the anode).

The first electrode layer 119 is disposed on the insulating layer 118 and divided by subpixels. A bank layer 120 is disposed on the insulating layer 118 and defines an emission area EMA (or an open area). In the first electrode layer 119, a portion covered by the bank layer 120 corresponds to a non-emission area and a portion exposed by removing the bank layer 120 corresponds to the emission area EMA.

The emission layer 121 is disposed on an exposed first electrode layer 119. The emission layer 121 may be disposed only on the exposed first electrode layer 119, or may be disposed on the bank layer 120 and the exposed first electrode layer 119. In the case where the emission layer 121 is disposed on the exposed first electrode layer 119, the emission layer 121 may be formed of a material that emits a red, green, or blue light.

On the contrary, in the case where the emission layer 121 is disposed on the exposed first electrode layer 119 and the bank layer 120, the emission layer 121 is formed of a material that emits a white light. The second electrode layer 122 is formed on the emission layer 121 and the bank layer 120. The second electrode 122 is electrically connected to the emission layer 121 included in every subpixel, and thus, it is referred to as a common electrode layer.

The central scan driver 157C is also implemented based on a transistor and a capacitor and thus disposed on the same layer on which the transistor unit TFTA is disposed. In addition, similarly to the transistor unit TFTA, the central scan driver 157C is protected by a protective layer and the like. The central scan driver 157C is covered by the insulating layer 118 which is formed later.

As shown in the FIG. 10, the OLEDs of the first subpixels SP1 have areas that partially overlap the central scan driver 157C. In other words, the emission areas EMA of the first subpixels SP1 are formed in an area that overlaps the central scan driver 157C.

An area in which the central scan driver 157C is arranged corresponds to the non-emission area NEMA. Thus, if a width of subpixels adjacent to the central scan driver 157C decreases, a dead zone where an image is not displayed is formed in the central area of the display panel, that is, the area in which the central scan driver 157C is arranged. In this case, there is a problem that a separation section in the form of a longitudinal line is formed in the central area of the display panel.

However, as in the structure of FIG. 10, if the emission area EMA of the first subpixels SP1 are formed on the central scan driver 157C, it is possible to prevent a separation section in the form of a longitudinal line in the central area of the display panel. That is, even though the central scan driver 157C is arranged in the central area of the display panel, it is possible to display an image without a dead zone as does the existing method.

If the first subpixels SP1, the second subpixels SP2, and the third subpixels SP3 are formed in the structure as shown in FIG. 10, not just widths W1 to W3 of the emission areas, but also the transistor unit TFTA disposed below the emission areas may become small in width toward the central scan driver 157C. This can be clear considering the example in which the transistor unit TFTA of the first subpixels SP1 is greater in width than the transistor unit TFTA of the third subpixels SP3. However, it is merely exemplary, and, if the first subpixels SP1, the second subpixels SP2, and the third subpixels SP3 are formed in the structure of FIG. 10, it is possible to gradually reduce only the width of the transistor unit TFTA while the widths W1 to W3 of the emission areas are set equal.

In addition, a distance between the OLED and the transistor unit TFTA may gradually increase toward the central scan driver 157C. This can be clear considering the example in which a distance between the OLED and the transistor unit TFTA of the third subpixels SP3 is smaller than a distance between the OLED and the transistor unit TFTA of the first subpixels SP1.

In addition, a length of the first electrode layer 119 may gradually increase toward the central scan driver 157C. This can be clear considering the example in which a length of the first electrode layer 119 of the OLED of the third subpixels SP3 is shorter than a length of the first electrode layer 119 of the OLED of the first subpixels SP1.

FIG. 11 (*a*) schematically illustrates a portion corresponding the central area of a display panel according to an existing proposed structure, and FIG. 11 (*b*) is a diagram schematically illustrating a portion corresponding to the central area of a display panel according to an embodiment of the present disclosure.

As found in the comparison between FIGS. 11 (*a*) and (*b*), what mainly differentiates the present disclosure from the existing proposed structure is that the central scan driver 157C is arranged in the central area of the display panel and that subpixels gradually decrease in width toward the central scan driver 157C. However, the drawing is provided to show just differences between the present disclosure and the existing proposed structure, and aspects of the present disclosure are not limited thereto.

Figure 12:
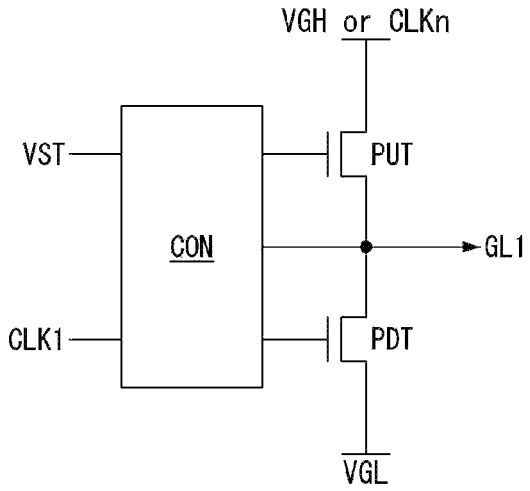
FIG. 12 shows an example of a circuit configuration of a scan driver.
Figure 13:
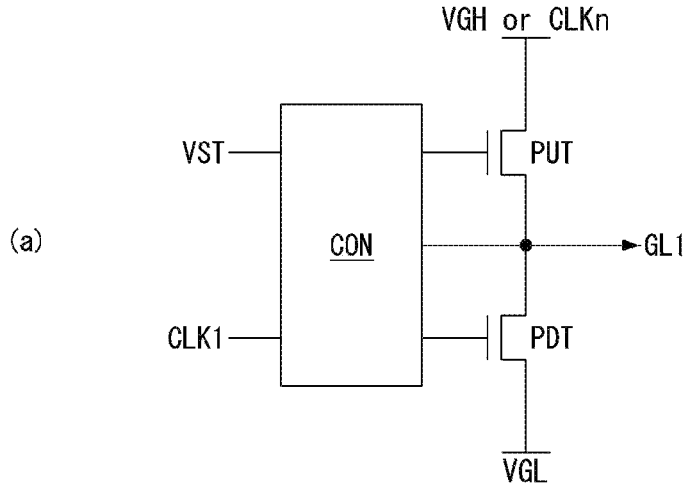
FIG. 13 is a diagram for explaining difference between the left and right scan drivers and the central scan driver according to an embodiment of the present disclosure.
Figure 13:
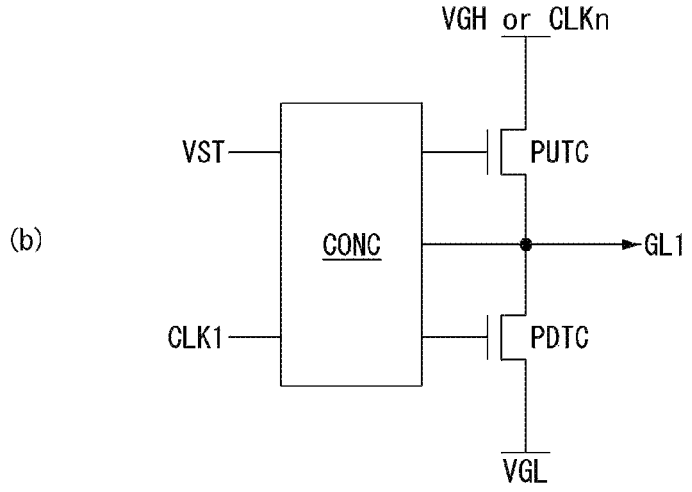

FIG. 12 shows an example of a circuit configuration of a scan driver, and FIG. 13 is a diagram for explaining difference between the left and right scan drivers and the central scan driver according to an embodiment of the present disclosure.

As illustrated in FIG. 12, a scan driver according to an embodiment of the present disclosure may include a first output buffer transistor PUT, a second output buffer transistor PDT, and an output controller CON. In addition, the scan driver may output a scan signal through an output terminal connected to a first scan line GL1.

The output controller CON may control the first output buffer transistor PUT and the second output buffer transistor PDT based on a start signal supplied through a start signal line VST and a first clock signal supplied through a first clock signal line CLK1.

Under the control of the output controller CON, the first output buffer transistor PUT may output a gate high voltage supplied through a gate high voltage line VGH or an N-th clock signal supplied through an N-th clock signal line CLKn. In addition, under the control of the output controller CON, the second output buffer transistor PDT may output a gate low voltage supplied through a gate low voltage line VGL.

As found in FIG. 12, the scan driver includes the first output buffer transistor PUT formed in an output terminal to output a scan signal, and the second output buffer transistor PDT.

Scan drivers are implemented as a first scan driver shown in FIG. 13(*a*) and a second scan driver shown in FIG. 13 (*b*). However, the first scan driver shown in FIG. 13 (*a*) and the second scan driver shown in FIG. 13 (*b*) are different under one of the following conditions.

First, as indicated as "PUT>PUTC" in the bottom of FIG. 13, the first output buffer transistor PUT of the first scan driver is greater in size than a first output buffer transistor PUTC of the second scan driver.

Second, as indicated as "PDT>PDTC" in the bottom of FIG. 13, the second output buffer transistor PDT of the first scan driver is greater in size than a second output buffer transistor PDTC of the second driver.

Third, as indicated as "CON>CONC" in the bottom of FIG. 13, the output controller CON of the first scan driver is implemented with more circuits than those of the output controller CONC of the second scan driver.

In the above description, the fact that a buffer transistor has a great size means that one of a channel width W and a channel length L of a transistor is great. In addition, the fact that an output controller is implemented with a number of circuits means that at least one of the number of transistors of the output controller and the number of capacitors of the output controller is great.

As proved above through the simulation of FIG. 8, even when one of the above conditions is applied to the central scan driver arranged in the central area of the display panel so as to miniaturize the central scan driver (e.g., minimalization of an output buffer in size) or simplify the central scan driver (e.g., simplified circuit configuration) compared to scan drivers arranged on the left and right sides, there is no problem with performance.

Thus, the first scan driver shown in FIG. 13 (*a*) may be applied as the left and right scan drivers of the display panel, and the second scan driver shown in FIG. 13 (*b*) may be applied to the central scan driver of the display panel. However, this is merely exemplary, and miniaturizing or simplifying the central scan driver of the display panel are not limited thereto.

Meanwhile, the embodiment of the present disclosure shows an example of a vehicle display panel which has a transverse length longer than a longitudinal length, as shown in FIG. 6. It is because scan signal delay is worse in a display panel having a transverse length longer than a longitudinal length, as shown in FIG. 6. In addition, if the present disclosure is applied to implement the display panel having the structure as shown in FIG. 6, it is possible to bring about more advantageous effects. However, the structure proposed in the present disclosure is applicable when not just to the structure shown in FIG. 6, but to any other structure is made in a large size.

In addition, the embodiments of the present disclosure shows an example in which only subpixels adjacent to the central area of a display panel decreases in size. However, the subject to decrease in size may expand to include all subpixels in the display panel. In this case, all the subpixels in the display panel gradually decrease in size toward the center area of the display panel.

As described above, when making a display panel in a large size, the present disclosure may prevent a luminescence deviation and degradation of a display quality from occurring due to scan signal delay. In addition, when implementing a vehicle display having a long transverse length, the present disclosure may miniaturize or simplify an auxiliary scan driver to thereby solve the scan signal delay.

What is claimed is:

1. A light emitting display device comprising:

a display panel having a display area in which an image is displayed, and a non-display area in which an image is not displayed;

a left scan driver arranged in a left non-display area and a right scan driver arranged in a right non-display area of the display panel; and a central scan driver arranged in a central area of the display panel, wherein subpixels arranged adjacent to the central area of the display panel have a smaller size than subpixels arranged in other areas of the display panel, wherein the subpixels arranged adjacent to the central area of the display panel are configured such that a length of a first electrode layer of a light emitting diode gradually increases toward the central scan driver, wherein the central scan driver has an output buffer smaller in size compared to the left scan driver and the right scan driver, and wherein the subpixels arranged adjacent to the central area of the display panel are configured such that a distance between a light emitting diode and a transistor unit increases toward the central scan driver.

2. The light emitting display device of claim 1, wherein the subpixels arranged adjacent to the central area of the display panel gradually decrease in size toward the central scan driver.

3. The light emitting display device of claim 1, wherein the subpixels arranged adjacent to the central area of the display panel comprise first subpixels, second subpixels, and third subpixels which are arranged on left and right sides to the central scan driver and which have sizes corresponding to each other.

4. The light emitting display device of claim 3, wherein the first subpixels are arranged most adjacent to the central scan driver compared to the second subpixels and the third subpixels, and have a smallest size, and wherein the third subpixels are arranged most distal from the central scan driver compared to the first subpixels and the second subpixels, and have a greatest size.

5. The light emitting display device of claim 3, wherein light emitting diodes or transistor units of the first subpixels, the second pixels, and the third subpixels are smaller in size compared to subpixels arranged in other areas.

6. The light emitting display device of claim 1, wherein at least one of the subpixels arranged adjacent to the central area of the display panel has a light emitting diode disposed on the central scan driver.

7. The light emitting display device of claim 1, wherein the left scan driver, the right scan driver, and the central scan driver are synchronized to simultaneously generate outputs.

8. A light emitting display device comprising:

a display panel having a display area in which an image is displayed, and a non-display area in which an image is not displayed;

a left scan driver arranged in a left non-display area and a right scan driver arranged in a right non-display area of the display panel; and a central scan driver arranged in a central area of the display panel, wherein subpixels arranged adjacent to the central area of the display panel are configured such that a length of a first electrode layer of a light emitting diode gradually increases toward the central scan driver, wherein the central scan driver has an output buffer smaller in size compared to the left scan driver and the right scan driver, and wherein the subpixels arranged adjacent to the central area of the display panel are configured such that a distance between a light emitting diode and a transistor unit increases toward the central scan driver.

9. The light emitting display device of claim 8, wherein the subpixels arranged adjacent to the central area of the display panel are smaller in size compared to subpixels arranged in other areas.

10. The light emitting display device of claim 8, wherein the left scan driver, the right scan driver, and the central scan driver are synchronized to simultaneously generate outputs.

11. The light emitting display device of claim 8, wherein subpixels arranged in the display panel have different sizes of light emitting diodes or transistor units depending on their positions on the display panel.

12. The light emitting display device of claim 8, wherein subpixels arranged in the display panel have different lengths of a first electrode layer of a light emitting diode depending on their positions on the display panel.

* * * * *